United States Patent [19]

Fernandez-Rana et al.

[11] 3,986,614

[45] Oct. 19, 1976

[54] SIGNATURE HANDLING

[75] Inventors: Victoriano Fernandez-Rana, Easton; William J. Marshall, Bethlehem; John N. Hobbs, Allentown, all of Pa.

[73] Assignee: Harris-Intertype Corporation, Cleveland, Ohio

[22] Filed: May 17, 1973

[21] Appl. No.: 361,176

[52] U.S. Cl. ..... 211/51; 108/55.3; 214/7; 214/10.5 R; 214/622; 271/220

[51] Int. Cl.[2] ..... B65G 57/00

[58] Field of Search ..... 214/7, 10.5 R, 622; 108/55, 51; 211/50, 51, 53; 271/214, 216, 220, 149

[56] References Cited

UNITED STATES PATENTS

| | | | |
|---|---|---|---|
| 986,069 | 3/1911 | Kohlhaas | 211/51 |
| 1,660,823 | 2/1928 | Thometz | 211/51 |
| 2,759,203 | 8/1956 | Kramer | 271/181 X |
| 2,912,113 | 11/1959 | Durec | 211/51 |
| 3,326,388 | 6/1967 | Zidek | 211/51 |

*Primary Examiner*—Frank E. Werner

[57] ABSTRACT

A tray is adapted to be supported on an elevator mechanism and moves vertically by the elevator mechanism to pick up a shingled array of signatures which are supported on edge in an inclined position adjacent the elevator mechanism. The tray includes a generally horizontally extending support portion adapted to engage the lower edges of the signatures as the tray is raised. A member located at one end of the tray has an inclined surface against which the last signature at one end of the tray rests. A clamp mechanism at the other end of the tray includes a clamp member which is engageable with the last signature in the array to clamp against that last signature.

4 Claims, 11 Drawing Figures

SIGNATURE HANDLING

BACKGROUND OF THE INVENTION

The present invention relates to a tray structure for supporting a plurality of signatures in a shingled array so that the signatures may be stored and used at a later time in the assembly of a newspaper, magazine, or the like.

Much development work in the area of automating the formation of newspapers, magazines, etc., is being undertaken. In the printing of newspapers frequently many sections of the paper are printed and stored at one time and combined in a suitable collator or stuffer with the current news which is printed currently. It has been suggested, and as disclosed in application Ser. No. 302,848, filed Nov. 1, 1972 now U.S. Pat. No. 3,840,130, and assigned to the assignee of the present invention, that the signatures which are to be stored be formed in a dense shingled array on a tray and that the tray may then be supported with other trays for purposes of storage of the trays until used in the assembly of the final newspapers or magazines.

The shingled array of signatures is provided on the tray by a mechanism disclosed in application Ser. No. 358,124 filed May 7, 1973 now U.S. Pat. No. 3,842,719 and assigned to the assignee of the present invention. In general, the tray is supported on an elevator mechanism beneath a dense shingling location. A dense shingled array of signatures is formed on a pair of conveyor belts which are spaced apart at the dense shingling location. Once the array of signatures has been formed the elevator mechanism is indexed upwardly so that the tray supported thereby picks up the dense shingled array of signatures from the spaced conveyor belts. In this manner, the dense shingled array is formed on the trays.

SUMMARY OF THE PRESENT INVENTION

The present invention is directed to the tray on which the signatures are stored and specifically is directed to a tray mechanism which has a clamp mechanism for clamping the signatures on the tray. The tray is adapted to be supported on an elevator mechanism and be moved vertically by the elevator mechanism to pick up a shingled array of signatures which are supported on edges in an inclined position adjacent the elevator mechanism as in application Ser. No. 358,124 filed May 7, 1973 now U.S. Pat. No. 3,842,719 referred to above. The clamp mechanism on the tray has a retracted position lying along the signature support, and is pivoted upon raising movement of the tray in order not to interfere with the pick up of the signatures. In addition, after the signatures are picked up on the tray, the clamp moves into a position where it clamps against the signatures on the tray.

Another feature of the present invention involves the use of a clamp mechanism which is mounted for movement along the tray so that the clamp mechanism may properly function to clamp arrays of signatures on the tray, even though the length of the signature arrays on the tray may vary. In accordance with this feature of the invention, the clamp mechanism is moved in one direction away from the signatures relative to the tray support upon raising movement of the tray and is released for movement by a spring into clamping engagement with the signatures once the signatures are received on the tray.

A plurality of trays, once they are provided with signatures clamped thereon, may be supported in a stacked arrangement on a single pallet for purposes of storage. In addition, the trays are constructed so that they nest when no signatures are on the trays to facilitate handling thereof.

DESCRIPTION OF THE FIGURES

Further features of the present invention will be apparent to those skilled in the art to which it relates from the following detailed description thereof made with reference to the accompanying drawings and in which.

DESCRIPTION OF DISCLOSED EMBODIMENTS

Figure 1:
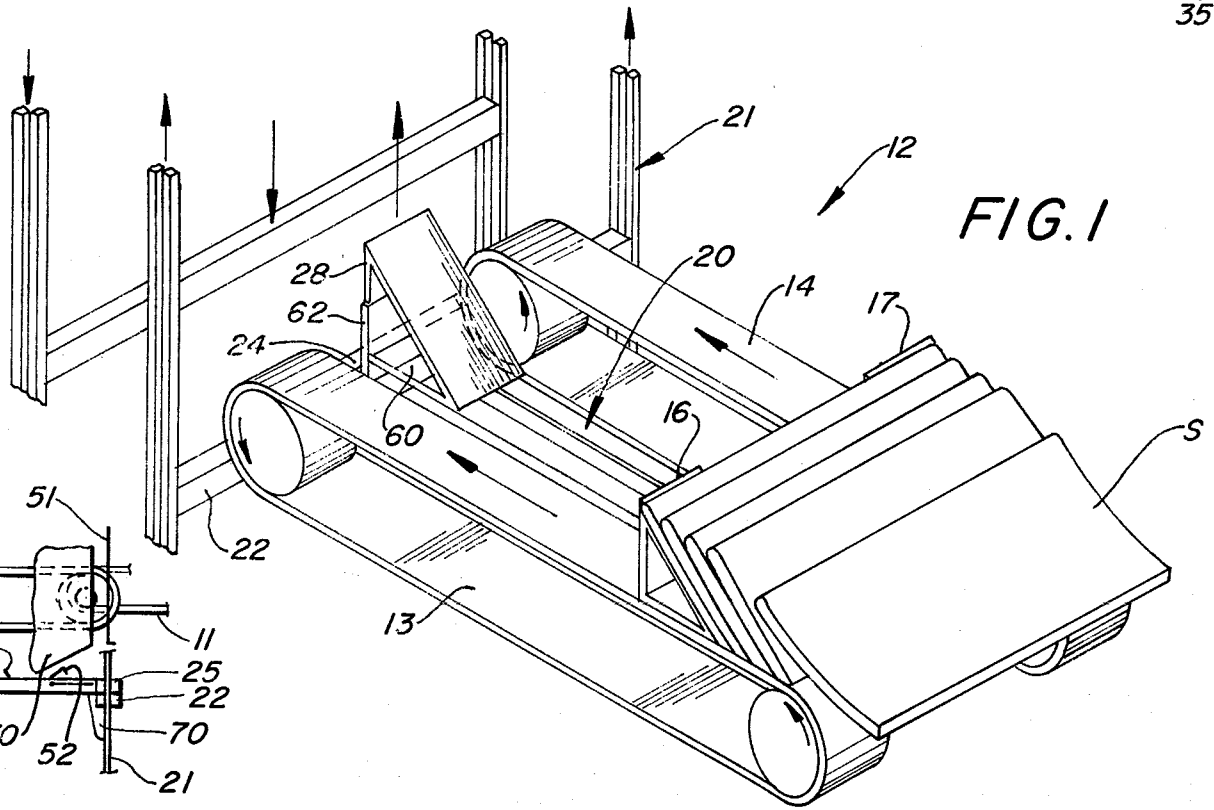
FIGS. 1 and 1A are schematic perspective views of an apparatus for forming a shingled array of signatures on a tray.
Figure 1A:
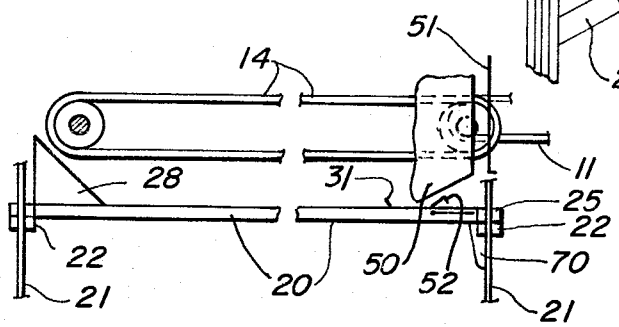

As noted hereinabove, the present invention relates to a tray for use in storing signatures prior to their use in the formation or assembly of a newspaper, magazine, or the like. The tray of the present invention supports the signatures in a shingled stacked array which is disclosed in application Ser. No. 358,124 filed May 7, 1973, now U.S. Patent No. 3,842,719, and assigned to the assignee of the present invention. The apparatus for forming the dense shingled array of signatures is schematically illustrated in FIG. 1. As shown in FIG. 1, the signatures S are fed in a shingled loose stream by a conveyor 11 to a dense shingling location 12. A pair of conveyor belts 13 and 14 are located at the dense shingling location and are spaced apart. Suitable inclined wedge members 16 and 17 are supported on the conveyors 13 and 14 and as the loose shingled stream is delivered onto the belts 13 and 14, the lead edges of the signatures are deflected upwardly and the trailing edges engage and are supported on the upper surfaces of belts 13, 14. The signatures are then resting at an inclined angle of preferably 45 degrees, as determined by the surfaces of the wedges 16, 17 on the belts 13, 14. Of course, as the shingled array develops, the wedges 16 and 17 move in a retracting direction, in the direction of the arrows shown in FIG. 1, to enable the array to be completely formed.

The tray, generally designated 20 in FIG. 1, is supported between the conveyor belts 13, 14 and below the upper surface of the conveyor belts 13, 14. The tray is supported in that position by an elevator mechanism, generally designated 21. The elevator mechanism includes a pair of chains at each end of the belts 13, 14, only one of which is disclosed. The elevator mechanism includes bars 22 which extend between the pair of chains on the opposite ends of the conveyors 13, 14. The bars 22 engage bars 24 and 25, respectively, at the opposite ends of the tray 20.

Figure 2:
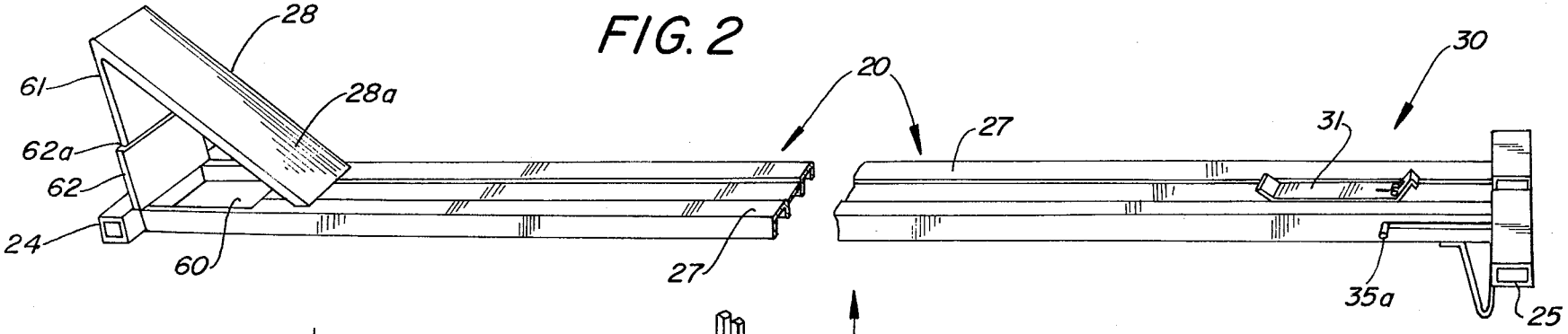
FIG. 2 is a perspective view partially broken of a tray used in the apparatus of FIG. 1 and embodying the present invention.

After the shingled array of signatures is formed on the belts 13, 14, the elevator mechanism 21 is indexed in an upward direction so that the tray picks up the shingled array from the belts 13, 14, as described in the aforementioned application. In this connection, the tray has a horizontally extending portion 27 which, as the tray is raised, engages the lower edges of the shingled signatures and picks up the shingled signatures from the conveyor belts 13 and 14. At the left end of the tray 20, as shown in FIG. 2, is a wedgeshaped member 28 which has an inclined surface 28*a* against which the signatures rest when the signatures are picked up by the tray 20 from the conveyor belts 13, 14, as disclosed in FIG. 3. The inclined surface is preferably at 45° to the support portion 27 and thus is inclined at the same angle as the signatures on the belts 13, 14.

Figure 3:
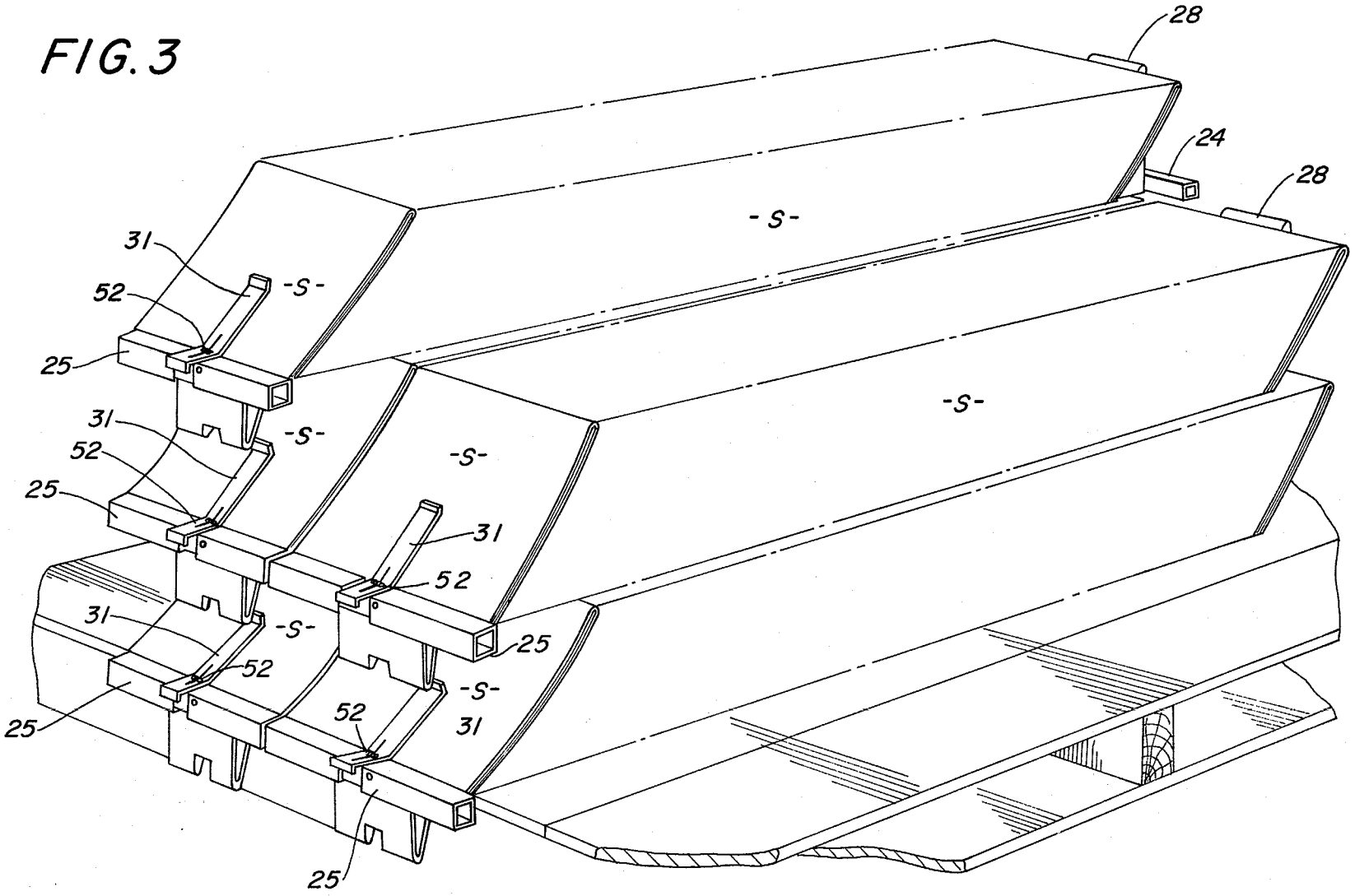
FIG. 3 is a view showing the stacking of the trays of FIG. 1.

As shown in FIG. 2 at the right end of the support portion 27 of the tray there is a clamp mechanism, generally designated 30. The clamp mechanism 30 includes a clamp member 31 which clamps against the signatures when they are formed and supported on the tray, as shown in FIG. 3. The clamp member when the tray is empty, as shown in FIG. 2, extends along the upper surface of the support portion 27. Of course, when the tray is in the position illustrated in FIG. 1 beneath the level of the conveyors 13, 14, the clamp member 31 is in the position illustrated in FIG. 2.

Figure 4:
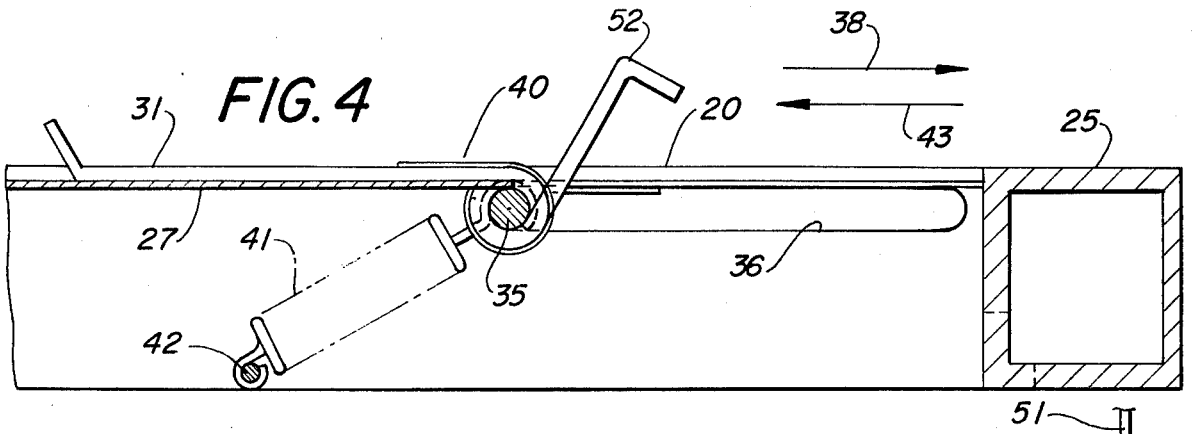
FIGS. 4–7 are schematic sectional views illustrating a structural portion of the tray of FIG. 2 with parts thereof in different positions at different times in the stacking operation.

Referring to FIGS. 4–7, these figures illustrate the various positions of the clamp member as the tray moves from the position shown in FIG. 1 to pick up the array of signatures from the upper surfaces of the belts 13 and 14. FIG. 4 illustrates the initial position of the clamp 31 when the tray is empty and is in the position shown in FIG. 1. In FIG. 4, it should be clear that the clamp member 31 is lying against the upper surface of the support portion 27 of the tray 20.

The clamp member 31 is supported for pivotal movement about the axis of a rod 35. The rod 35 extends through slots 36 in the tray and extends across the width of the tray. The rod 35 has portions 35*a* which extend beyond the opposite sides of the tray 20. Not only is the clamp member 31 supported for pivotal movement about the axis of the rod 35, but the clamp member may also be moved along the support portion 27 of the tray in the direction of the arrow 38 in FIG. 4 by sliding movement of the rod 35 in the slots 36. From the above, it should be apparent that the clamp member 31 is supported for pivotal movement from the position shown in FIG. 4 to a vertical position about the axis of the rod 35. In addition, it should be clear that the clamp member 31 is movable in a direction along the support 27.

A first spring 40 is provided in the nature of a torsion spring and which acts between the support portion 27 of the tray and the clamp member 31 and biases the clamp member 31 in a direction counterclockwise about the axis of the shaft 35, as viewed in FIG. 4. The torsion spring 40 biases the clamp member 31 to its position shown in FIG. 4. In addition a second spring means in the form of a pair of coil springs 41 are provided acting between pins 42 on the tray 20 and the shaft 35. The coil springs 41 bias the shaft member 35 and also the clamp member 31 toward the left in the direction of the arrow 43 in FIG. 4. Movement of the clamp member 31 in the direction of the arrow 38 must occur against the bias of springs 41, and the springs hold the shaft 35 at one end of the slot 36 when the tray is in the position of FIGS. 1 and 4.

It should be clear from the above that due to the action of the springs 41 and 40, the clamp member 31 takes a position as shown in FIG. 4 when the tray is in the position of FIG. 1. As the tray raises due to the indexing action of the elevator mechanism 21, a pair of cam members, only one of which is shown in the drawings and designated 50, engages the projecting ends 35*a* of the rod 35 and moves the clamp member 31 and rod 35 in the direction of the arrow 38 in FIG. 4. This movement occurs in opposition to the bias of the springs 41 and causes a sliding movement of the rod 35 in the slot 36. The cams 50 are located in the apparatus and adjacent the elevator mechanism 21 so as to move the clamp member to the position shown in FIG. 5 prior to engagement of the tray with the signatures supported on the conveyor belts 13, 14.

Figure 5:
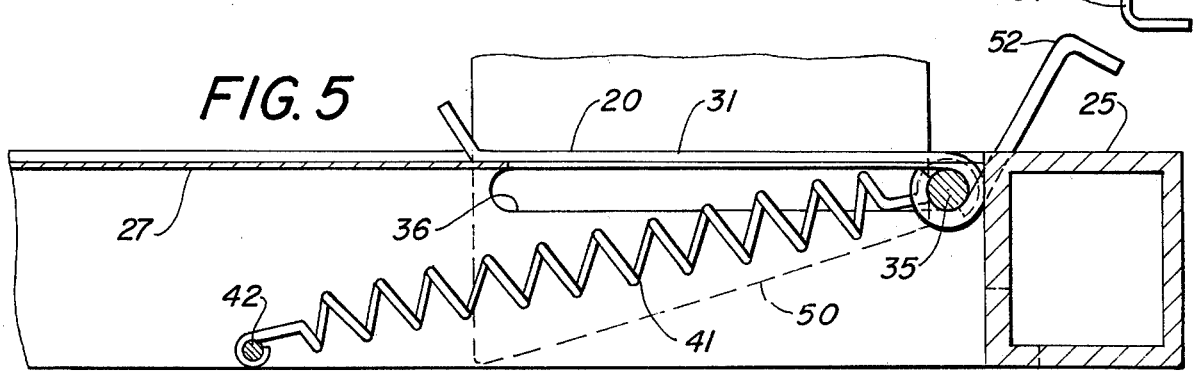
Figure 6:
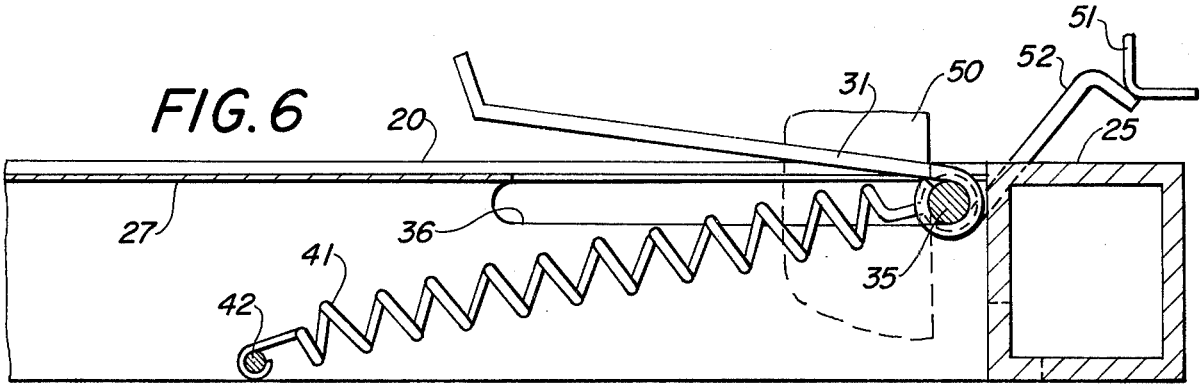
Figure 7:
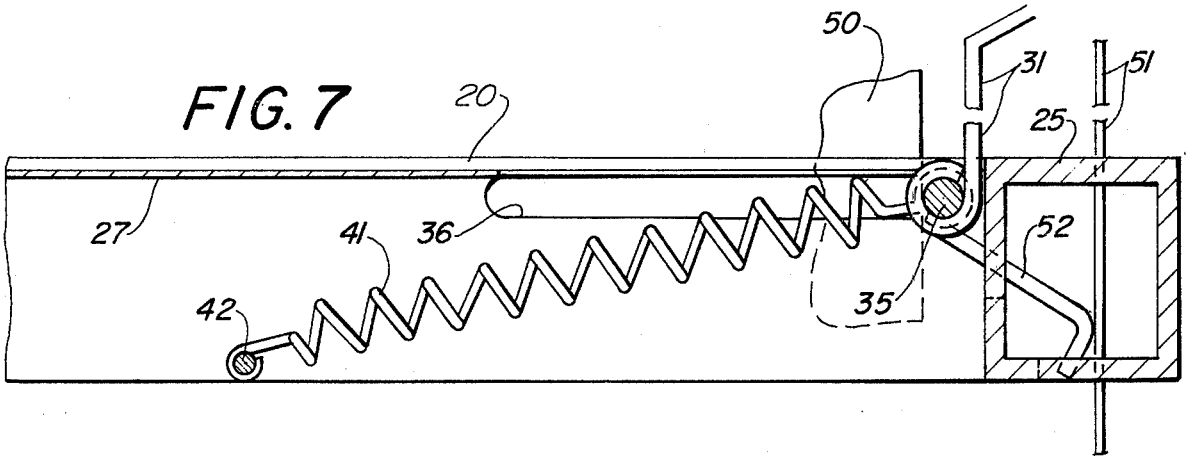

After the cam members 50 have moved the clamp member 31 to the position illustrated in FIG. 5, another cam member, generally designated 51, engages a projecting actuator portion 52 of the clamp member 31. The portion 52 of the clamp member 31 projects outwardly from the rod 35 in a direction away from the support 27. When the cam 51 engages the actuator portion 52 of the clamp member 31 on the vertical movement of the tray, the clamp member 31 is pivoted in a clockwise direction against the action of the torsion spring 40, to a position as illustrated in FIGS. 6 and 7. When the support portion 27 initially engages the lower edges of the signatures to pick up those signatures from the conveyors 13, 14, the clamp member 31 is in the position illustrated in FIG. 7. In this position, the cam member 50 still maintains the support rod 35 in its position to which it was moved in the direction of the arrow 38 against the bias of the spring 41, and also the cam 51 maintains the clamp member 31 in a vertical position.

As a result of the above-described movements, the clamp member 31 is moved completely out of the position illustrated in FIG. 4 so that it will not interfere with the picking up of the signatures by the support portion 27 of the tray on vertical movement of the elevator mechanism. As soon as the signatures are supported on the support portion 27 of the tray 20, the tray is moved beyond the cam members 51, 50. As a result, the torsion spring 40 and the springs 41 cause actions to occur; one, the clamp member 31 pivots in a clockwise direction about the axis of the rod 35, and two, at the same time the rod 35 and clamp member 31 are moved to the left, as viewed in FIGS. 4–7. As a result of these actions the clamp member 31 moves into a secure clamping engagement with the last signature in the array, as shown in FIG. 3.

These various movements provide not only for clamping the signatures in the array, but also allow for a different length of signatures to be clamped on the tray. While normally the number of signatures to be clamped on the tray will remain the same, depending upon the characteristics of the stacked array, the particular dimension or length of the stacked array may vary. The above-described clamping action will occur even over a range of lengths of the stacked array. This is due to the fact that the clamp may move along support 27 due to the construction thereof. As a result, when the clamping action occurs, the rod 35 may not be in the position illustrated in FIG. 4, but may be spaced from that position and may be located at any intermediate point along the slot 36 between the opposite ends of the slot 36.

Once the trays have received the stacked array of signatures, the trays may be placed on a pallet P for purposes of storage, as shown in FIG. 3. The bars 24, 25 are constructed so that their length is not greater than the width of the signatures. Thus, when the trays are stacked on a pallet, the signatures on one tray can abut the signatures on the adjacent trays, as shown in FIG. 3. As a result, a maximum of signatures can be placed on a pallet without space between the stacks of full trays on the pallet. In addition, the trays may be stacked one upon the other on the pallet. In this connection, the clamp mechanisms clamp the signatures on the trays during this storage period, and due to the clamping of the signatures each tray is in and of itself a unitary assemblage that can be readily handled and moved with a minimum of problems of the stack loosening or signatures falling off the tray.

Figure 8:
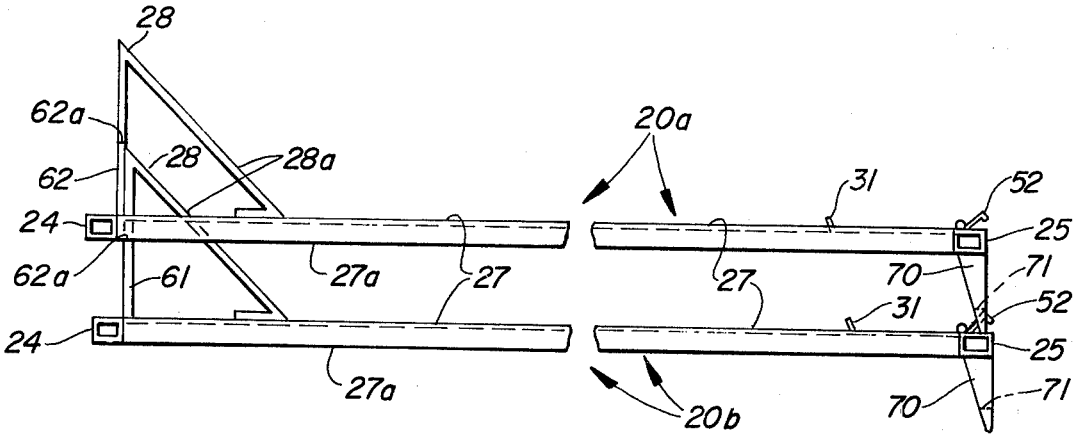
FIG. 8 illustrates the stacking of the trays in a nested relation when the trays are empty.

From the above, it should be apparent that applicant has provided a substantially new and improved tray construction for purposes of storing signatures. In addition, the tray construction is such as to facilitate the nesting of the trays when the trays are empty. This nesting feature is illustrated in FIG. 8 in a schematic way. As shown in FIG. 2, each tray at the left end thereof is provided with an opening 60 in the portion 27 thereof beneath the inclined surface 28*a* of the member 28. In addition, the member 28 is supported on the tray by a vertically extending portion 61. The vertically extending portion at the lower end thereof has a greater width as indicated by the reference numeral 62, and a pair of shoulders 62*a* are thereby provided.

As shown in FIG. 8, when the trays are in a nested condition, the upper portion of the section 61 and member 28, of a lower tray, project upwardly into the opening 60 in the upper tray. This is illustrated in FIG. 8, where the upper tray is designated 20*a* and the lower tray is designated 20*b* . The lower surface of the support portion 27, namely, the surface 27*a* thereof of the upper tray 20*a*, rests on the shoulders 62*a* formed on the lower tray. On the right side of the tray, there is a downwardly projecting portion, generally designated 70, and that portion 70 engages the upper surface of the right end of the lower tray 20*b*. The portion 70 has a cutout 71 in it so that it does not interfere with the actuating portion 52 of the clamp mechanism 30 when stacked. The opening is shown in full lines in FIG. 3, and in dotted lines in FIG. 8. Of course, the vertical dimension of the portion 70 is identical to the vertical height of the shoulders 62*a* above the surface of the support portion 27 of the tray. As a result, the trays will be formed in a nested relation and in a generally level orientation.

Figure 9:
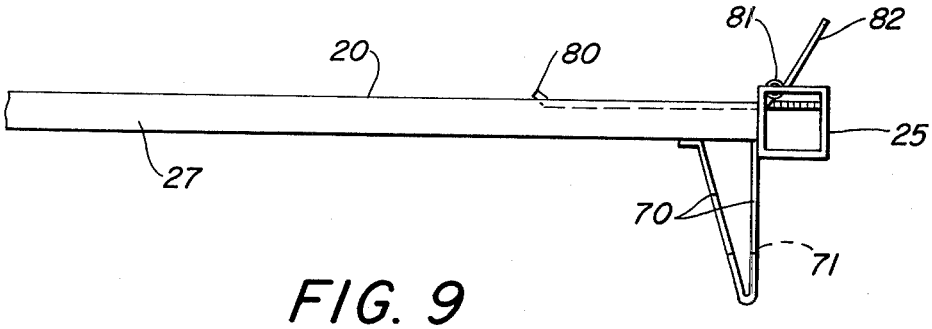
FIGS. 9 and 10 illustrate different tray constructions also embodying the present invention.

A modified embodiment of the present invention is illustrated in FIG. 9. The basic difference between the embodiment shown in FIG. 9 and that of FIG. 2 is that the clamp mechanism of FIG. 9 is supported only for pivotal movement rather than for both pivotal and longitudinal movement along the support surface of the tray. In the embodiment of FIG. 9, a clamp member 80 is provided and the clamp member 80 is supported for pivotal movement about an axis of a rod 81. An actuator portion 82 of the clamp mechanism projects outwardly so as to engage a cam similar to the cam 51 in the embodiment disclosed in FIGS. 4–7. A suitable torsion spring is provided and not shown for biasing the clamp member 80 in a counterclockwise direction about the axis of the rod 81. Other than for the above, the construction is similar to that shown in FIG. 2 and will not be further described.

Figure 10:
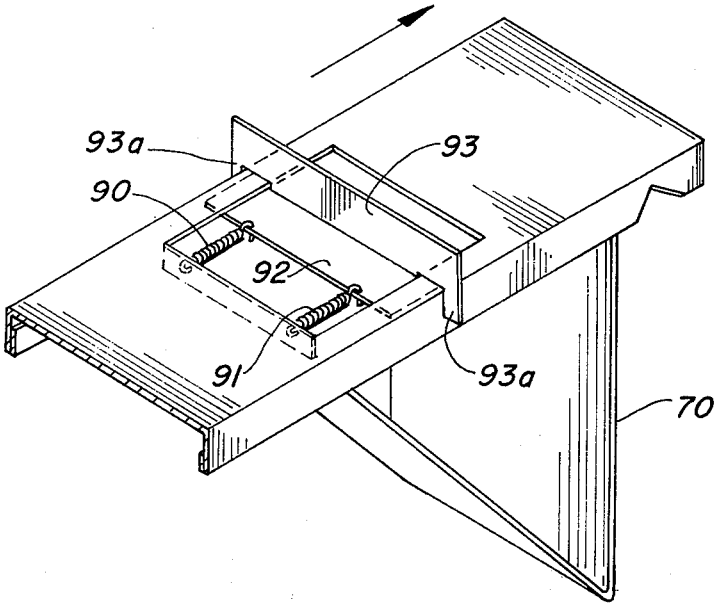

A further embodiment of the present invention is illustrated in FIG. 10 in which rather than a pivoting clamp member being utilized, the clamp member does not pivot but does move horizontally along the support surface 27 of the tray. In this embodiment, springs, generally designated 90 and 91, act against a horizontally extending plate portion 92. The plate portion has a vertically extending clamp portion 93 thereon. The clamp portion slides along the upper surface of the tray under the action of the springs 90 and 91. The clamp portion 93 and plate portion 92 may be moved in the direction of the arrow 95 by cams which engage the projecting ends 93*a* of the clamp member 93. Accordingly, it should be apparent that in the embodiment of FIG. 10, the clamp moves only along the length of the tray and does not have any pivoting action with respect to the tray.

From the above, it should be apparent that applicant has provided a substantially improved tray construction for storing signatures and that changes and modifications can be made therein without departing from the spirit of the invention.

Having described the invention, what is claimed is:

1. Apparatus for supporting a shingled array of signatures on-edge in an inclined position, said apparatus comprising a generally horizontally extending support portion for engaging the lower edges of the signatures, said apparatus having a portion at one end which has an inclined surface against which the last signature at one end of said array rests and a clamp mechanism supported on the apparatus at the other end thereof and including a clamp member engagable with the last signature in the array to clamp against said last signature and thereby clamp said plurality of signatures against said inclined surface portion, said clamp mechanism including means defining an axle for supporting said clamp member for pivotal movement about an axis, first force applying means for biasing said clamp member for pivotal movement in a first direction about said axis, said clamp mechanism further including means for supporting said axle for movement along a predetermined path, second force applying means for biasing said axle in a first direction along said predetermined path, said first and second force applying means biasing said clamp member into a predetermined rest position substantially adjacent to said horizontally extending support portion when no signatures or an array of signatures of less than a predetermined size is supported on said horizontally extending support portion and biasing said clamp member into engagement with the array of signatures when an array of signatures which is equal to or greater than said predetermined size is supported on said horizontally extending support portion.

2. Apparatus as set forth in claim 1 wherein said means for supporting said axle for movement along a predetermined path includes means for supporting said axle for movement along a linear path.

3. Apparatus as set forth in claim 1 including first actuating surface means connected to said clamp member, said first acuating surface means being engageable with a first actuating means for pivoting said clamp member in a second direction about said axis and against the bias of said first force applying means.

4. Apparatus as set forth in claim 3 including second actuating surface means connected to said axle, said second actuating surface means being engageable with a second actuating means for moving said axle in a second direction along said predetermined path and against the bias of said second force applying means.

* * * * *